United States Patent [19]

Slabaugh

[11] Patent Number: 4,531,372

[45] Date of Patent: Jul. 30, 1985

[54] CRYOGENIC PUMP HAVING MAXIMUM APERTURE THROTTLED PART

[75] Inventor: Edward J. Slabaugh, San Jose, Calif.

[73] Assignee: Comptech, Incorporated, San Jose, Calif.

[21] Appl. No.: 514,156

[22] Filed: Jul. 15, 1983

Related U.S. Application Data

[63] Continuation-in-part of Ser. No. 412,251, Aug. 27, 1982, Pat. No. 4,393,896.

[51] Int. Cl.[3] ..... B01D 8/00

[52] U.S. Cl. ..... 62/55.5; 55/269; 62/268; 137/601; 415/160; 417/901

[58] Field of Search ..... 62/100, 268, 55.5; 137/601; 417/901; 55/269; 415/160

[56] References Cited

U.S. PATENT DOCUMENTS 4,187,879 2/1980 Fermer et al. ..... 137/601
4,198,829 4/1980 Carle ..... 62/55.5
4,285,710 8/1981 Welch ..... 62/55.5
4,393,896 7/1983 Slabaugh ..... 137/601

*Primary Examiner*—Ronald C. Capossela
*Attorney, Agent, or Firm*—Thomas Schneck

[57] ABSTRACT

A low-temperature pump having a throttling valve formed by tilting radially disposed vanes in side-by-side relation, capable of fully opening a pump port to a process chamber. Motion from one vane can be coupled to the next through shims which support the vanes and form a seal when the vanes are flat in a common plane. One of the vanes may be controlled independently of the others so that coarse and fine modes of operation may be achieved by separately controlling (N − 1) vanes and the Nth vane. The vanes are maintained in thermal contact with a chilled outer wall surface of a first pumping stage of a two-stage pump, the second stage coaxially surrounding a first stage maintained at a very low temperature. A central hub, at the convergence region for the vanes, supports a shield, protecting the second stage from radiation through a port in the upper regions of the pump.

20 Claims, 13 Drawing Figures

CRYOGENIC PUMP HAVING MAXIMUM APERTURE THROTTLED PART

CROSS REFERENCE TO RELATED APPLICATION

This is a continuation-in-part of prior application Ser. No. 412,251, filed Aug. 27, 1982, now U.S. Pat. No. 4,393,896.

TECHNICAL FIELD

The invention relates to cryogenic pumping, and in particular to a fully throttled cryogenic pump.

BACKGROUND ART

Throttled cryogenic pumps are known, as shown in U.S. Pat. No. 4,285,710. That patent describes a pump having a throttling valve disposed across a port of the pump facing a process chamber. The throttling valve is of the transverse sliding vane type, with a solid portion and pie-shaped apertures in the solid portion which are closed by sliding vanes. While this type of cryogenic pump has enjoyed commercial success, I have observed that the full capacity of the pump cannot be used because the solid portion of the throttling valve shields the interior of the pump from gas which can be pumped from the process chamber. This problem is not limited to the throttling valve shown in the patent. Virtually all throttling valves have a portion of the vane structure, or the supports therefor, blocking a portion of a port giving access to a pump.

An object of the invention is to provide a cryogenic pump and throttling valve having a port which is fully openable at the throttling valve. Such a pump would have greater efficiency relative to the prior art.

DISCLOSURE OF INVENTION

The above object has been achieved by providing a radial vane throttling valve across the port of a cryogenic pump in a manner such that valve surfaces, at a common temperature with a portion of the pump's low temperature surfaces, are fully openable such that the valve surfaces do not block the pumping port. The valve features radial vanes which, when the valve is closed, lie in a plane disposed transverse to a valve port. When the valve is open, each vane tilts out of this plane along a line which is an approximate axis of symmetry of the vane. The radially outward support for each vane is a shim mounted in a peripheral flange or wall such that the vane supports may be outside of a pumping port if the flange is disposed outside of the port, or may be inside of the pumping port.

In one embodiment, the flange is disposed immediately over the rim of the port such that the flange does not obstruct any portion of the port aperture. The only portion of the vane structure which obstructs the port when the vanes are fully open is a small central hub. The entire valve is maintained at cryogenic temperatures such that the vanes form a portion of the pump. This is especially convenient where the pump is a two-stage pump of the type having a chilled outer surface for first stage pumping of gases condensible at medium temperatures and a chilled inner surface for second stage pumping of gases condensible at low temperatures. The second stage is positioned coaxially within the first stage in a typical configuration. The vanes are thermally connected to the first stage at the medium temperature. The top of the first stage has an annular rim, forming the port mentioned above. The flange of the valve is radially beyond the rim such that the vane supports are not in the gas flow path through the port.

In another embodiment, the flange may be disposed within the port at the outer peripheral wall. In this case, the port aperture may be reduced, depending on whether a flange is used for vane support, but by a lesser aperture reduction than prior art valves. Moreover, the reduction occurs at the port outer rim, associated with first stage pumping, at the higher of the two cryogenic temperatures of a two stage pump. The second stage pumping region, which is coaxially within the first stage, is remote from the flange. The vanes are able to effectively modulate a gas stream relative to the second stage by providing vanes which may be fully open relative to the second stage and which are at approximately the same temperature as the first stage.

A benefit of the present invention is greater efficiency in cryogenic pumps. This occurs because a greater amount of gas may pass through the pump port, since a valve structure is provided which allows the pump port to be fully open.

BEST MODE FOR CARRYING OUT THE INVENTION

The present invention comprises a combination of a cryogenic pump, preferably having two stages, one coaxially disposed within the other, and a throttling valve. The structure of the throttling valve was the subject of prior patent application Ser. No. 412,251, now U.S. Pat. No. 4,393,896. The throttling valve structure will be reviewed prior to the description of the entire low temperature pumping apparatus.

a. Throttling Valve Structure

Figure 1:
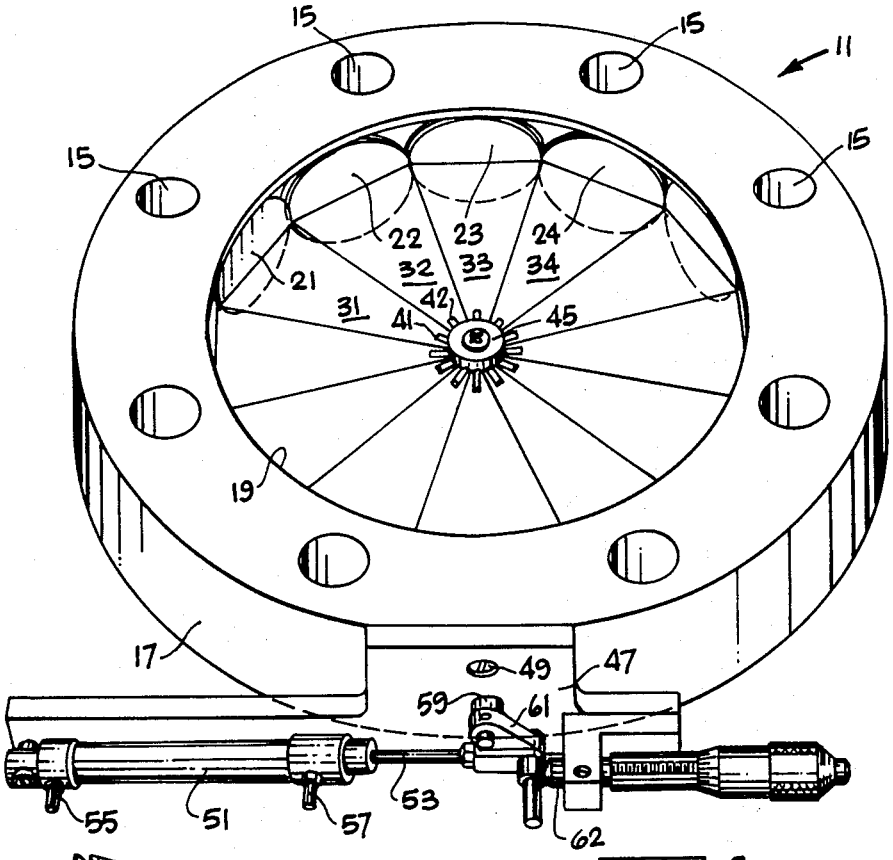
FIG. 1 is a perspective view of a gas throttling valve, with the vanes in a closed position, in accord with the present invention.

With reference to FIG. 1, a throttling valve used in the cryogenic pump of the present invention is illustrated. The valve is housed in an annular flange 11 having an upper side 13 and an opposed lower side, not shown. A plurality of holes 15 extends through the opposed sides of the flange, but does not break the gas barrier relationship between the outer peripheral surface 17 and the inner peripheral surface 19. Between upper side 13 and the opposed side, spaced circumferentially about the inner peripheral surface of the flange are a number of rotatable shims 21, 22, 23, 24, and so on. Each of these shims occupies a space between a corresponding connected vane 31, 32, 33, 34, and so on and the inner peripheral surface 19 of the flange. The shims are mounted for rotation, like bearings, within the flange and carry the vanes with them. Each vane has a corresponding tip 41, 42, and so on held within a hub 45 in a manner such that the tips 41, 42 can rotate within the hub 45. The shims are mechanically coupled, as explained below, such that one shim, a driver shim, can couple rotational energy from outside the flange to the driver which, in turn, transmits energy to the remaining driven shims. A bracket 47 is connected to the outer peripheral surface 17 by means of screw 49. Bracket 47 carries an actuator 51 having a plunger 53 controlled by fluid inputs to orifices 55 and 57. A servo controller may supply fluid to the orifices so that a piston within the actuator 51 is moved back and forth, controlling the motion of plunger 53 so that the desired valve opening is obtained.

Plunger 53 turns a shaft 59 connected to a sealed bearing which couples rotational motion imparted by a crank 61, the distant end of which is moved by plunger 53. A manually operated stub 63 is available as an alternative to use of actuator 51. A manually or electrically operated micrometer barrel 65 is used to adjust sleeve 67 which provides an abutment or stop for the outward end of crank 61. The micrometer barrel 65 may also be used to measure the crank position at various valve settings.

Figure 2:
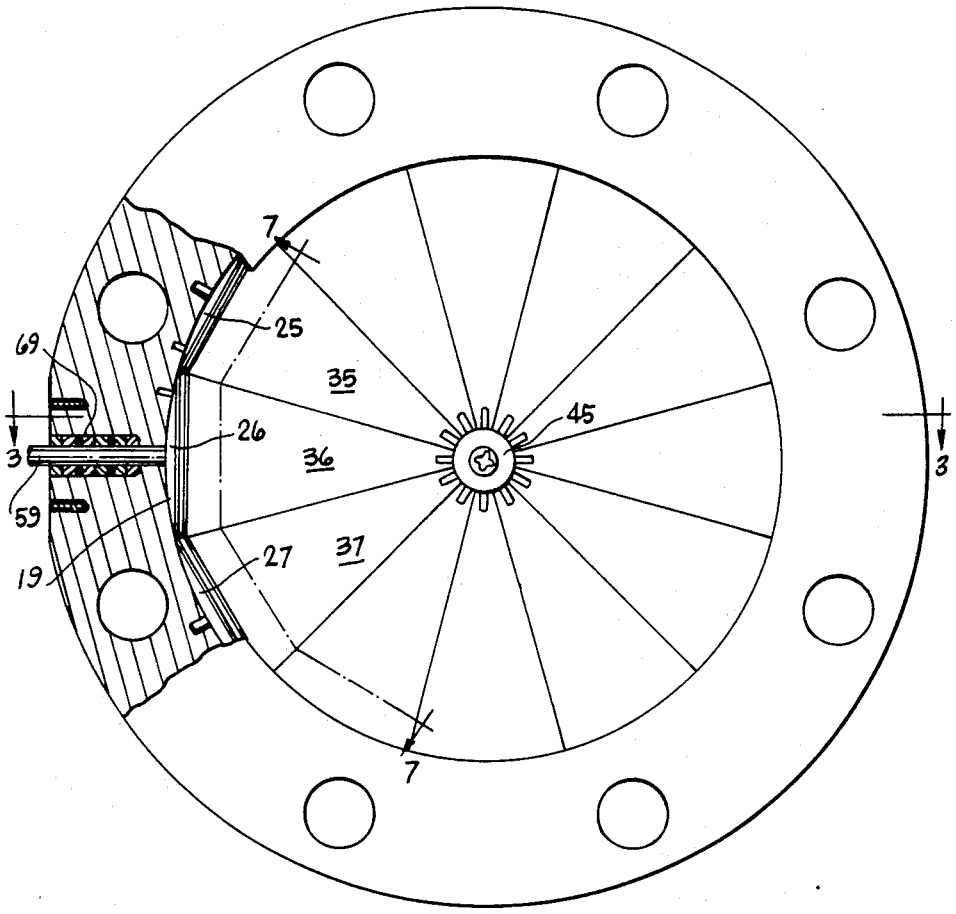
FIG. 2 is a top partially cutaway view of the valve of FIG. 1.

With reference to FIG. 2, the shims 25, 26 and 27 may be seen to block the space between vanes 35, 36, 37 and the inner peripheral surface 19 of the flange. The side of a vane which faces the inner peripheral surface of the flange is a toric surface. A toric surface is usually defined as a portion of the surface of a torus. A torus usually has two radii, including a major radius for the entire torus and a minor radius which is the cross sectional radius. In the present case, a toric surface refers to the fact that the surface has a major radius corresponding to the radius of the inner peripheral surface. The arc defined by this radius lies in the same plane as a vane supported by the shim. In this manner, when the vanes are in the closed position, the arcs on adjacent shims are aligned such that rim-to-rim contact of the shims seals the opening through the flange. In order to do this, it is only necessary that the shims have arcs in the plane of the vane that match the interior peripheral surface of the flange. The remainder of the shim can have other curvatures. This surface is termed a toric surface because the other curvatures may cause the shim to resemble the surface of a spectacle lens, frequently a toric surface.

Shaft 59 is a portion of a sealed bearing which includes a shaft seal 69 of a commercially available type, such as a Ferrofluidic seal or conventional O-ring shaft seals.

Figure 3:
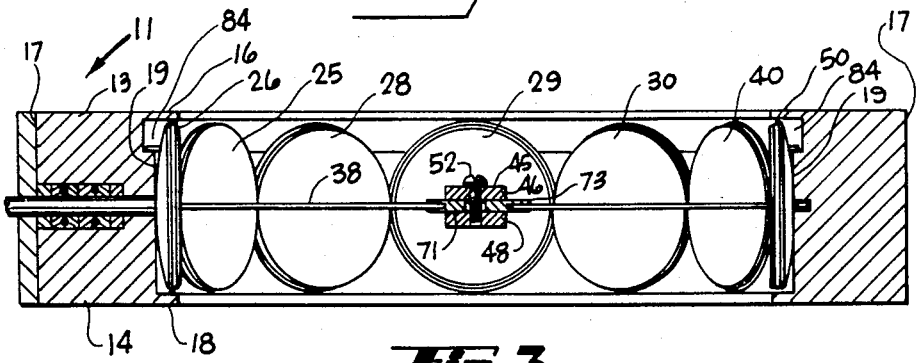
FIG. 3 is a sectional view of the valve of FIG. 2 taken along lines 3—3.

With reference to FIG. 3, the rim-to-rim alignment of the shims 26, 25, 28, 29, 30, 40 and 50 may be seen. The shims are in a position such that the vanes connected to the shims form a common plane 38 such that the valve is in a closed position. It will be seen that flange 11 has the outer peripheral surface 17 spaced from the inner peripheral surface 19. Surface 19 exists between opposed sides, including the upper side 13 and the lower side 14. Both of these sides have lip regions 16 and 18, respectively, which form overhanging regions, hiding the shims with respect to a gas flow path, i.e., between a pump and a chamber. Thus, except for hub 45, the gas flow pattern encounters only the vanes for a very low impedance path when the valve is fully open. There is no baffling of the vanes by the shims, as in prior art devices.

The hub 45 may be seen to be constructed of two disks 46 and 48, connected together by a screw 52. The two disks have slots for receiving rounded pins 71, 73 associated with vanes. The reason that the two-disk hub construction is important is that it permits assembly of the vanes and shims which are mounted before the hub is positioned. Only after the hubs and shims have all been mounted, the hub is put into place.

Figure 4:
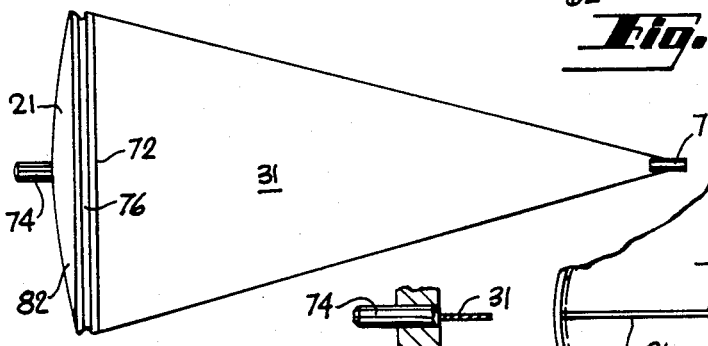
FIG. 4 is a side view of a shim and radial vane in accord with the present invention.

FIG. 4 shows a representative shim 21 with a toric outer surface 22 matching the curvature of the inner peripheral surface of the flange. The opposite side of the shim supports a vane 31. Note that the vane is wedge-shaped with a wedge tip 71, a pivot pin which fits into a corresponding opening in the hub. The opposite side of the vane is a base 72 which is supported by the shim along a line which lies in the same plane as the arcuate region of the toric surface of the shim which matches the curvature of the inner peripheral region of the flange. The toric surface 82 has a pin 74 extending therefrom for mounting in a shallow bore of the inner peripheral surface of the flange.

Figure 5:
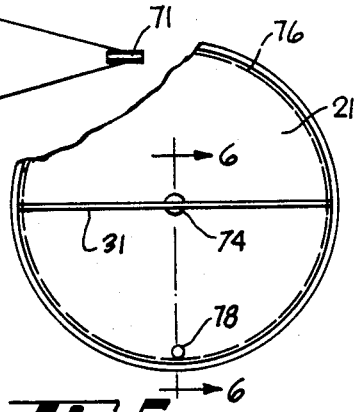
FIG. 5 is an inward, cutaway, elevation of the shim and vane of FIG. 4.

In FIG. 5, the projection of the toric surface may be seen to be circular with pin 74 at the center of the circle and the plane of the vane 31 passing through the center. In FIGS. 4 and 5 the shim 21 may be seen to have a groove 76 about the rim of the shim. The purpose of the groove is to carry a cable which provides rim-to-rim transfer of motion between shims. Alternatively, the rim could be provided with teeth for meshing contact between adjacent shims. The circular configuration of the shims implies that the toric surface of the shim is a truncated hemisphere. This is a preferred shape of ease of fabrication. Each shim carries a guide stub which fits into an optional slot provided about the circumference of the inner peripheral surface of the flange. Such a guide slot might have a width equal to, say 20% of the width of the flange between opposed sides. The purpose of such a slot, illustrated in FIG. 3 as slot 84, is to limit the amount of rotation of the shims from 0 degrees when the shims are all in the same plane to approximately 90 degrees when the valve is fully open. In other words, the slot 84 prevents the vanes from being inclined at an angle of more than 90 degrees.

Figure 6:
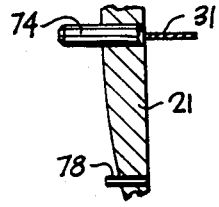
FIG. 6 is a sectional view of the shim of FIG. 5, taken along lines 6—6.
Figure 7:
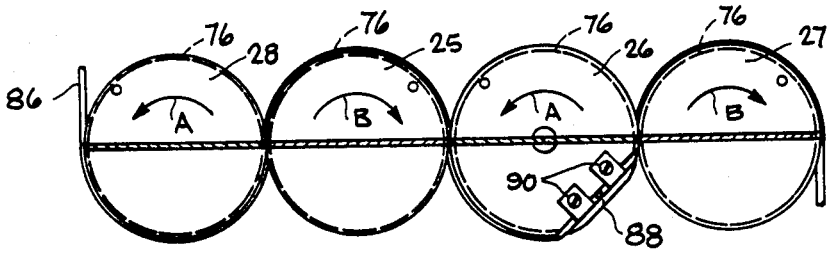
FIG. 7 is a radial view of rim-to-rim alignment and mounting of shims, taken along lines 7—7 of FIG. 2.

In FIG. 6, the guide stub 78 is seen to protrude in the same direction as the mounting pin 74. Transfer of rotational motion between shims is illustrated in FIG. 7 wherein side-by-side alignment of shims 28, 25, 26 and 27 is illustrated. A cable 86 is seen to be wrapped in a serpentine pattern about the grooves 76, indicated by dashed lines, in each shim. The ends of the cable may be clamped by a keeper 88 connected to a flat spot in a shim and held in place by the screws 90. The serpentine pattern of the cable causes adjacent shims to rotate in opposite directions as indicated by the arrows A and B.

Figure 8:
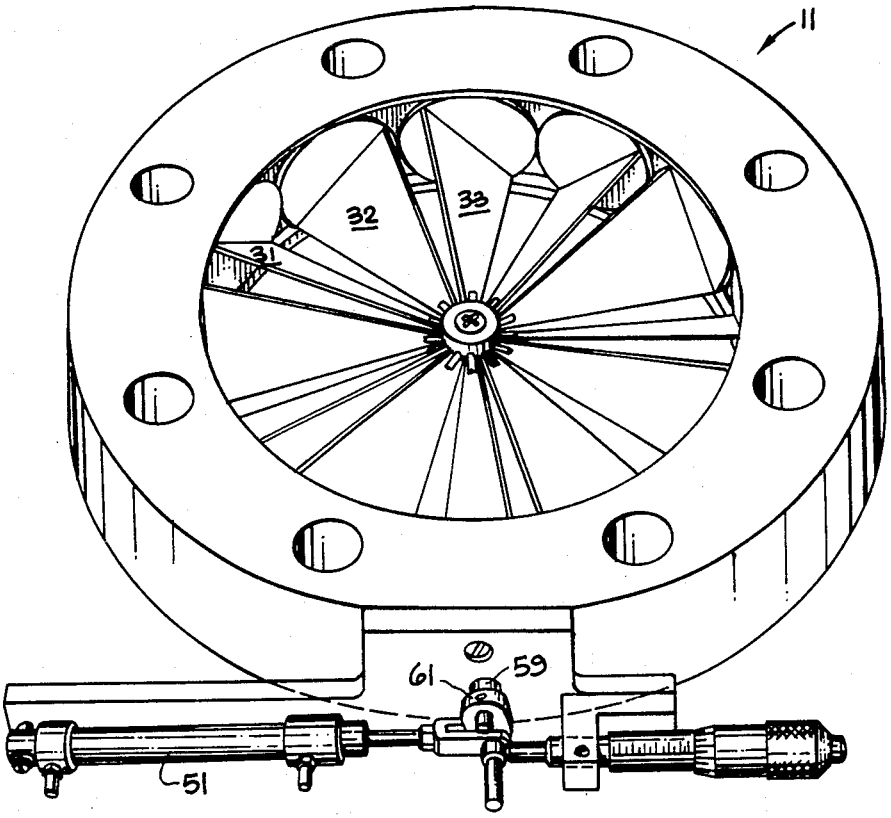
FIG. 8 is a perspective view of the gas valve of FIG. 1 with vanes in a partially open position.

With reference to FIG. 8, the vanes 31, 32, 33 and so on are seen to have rotated slightly upon movement of the crank 61. In this position, the valve is slightly open, allowing gas flow therethrough. The micrometer barrel could be advanced to measure the position of the crank or may be left in place to act as a stop at a desired position.

Note that the penetration of a single shaft 59 through the annular flange 11 minimizes the opportunity for gas leakage. While this advantage makes the valve very useful for vacuum systems applications, it will be realized that the valve can also be used in non-vacuum applications where gas flow is to be regulated.

Figure 9:
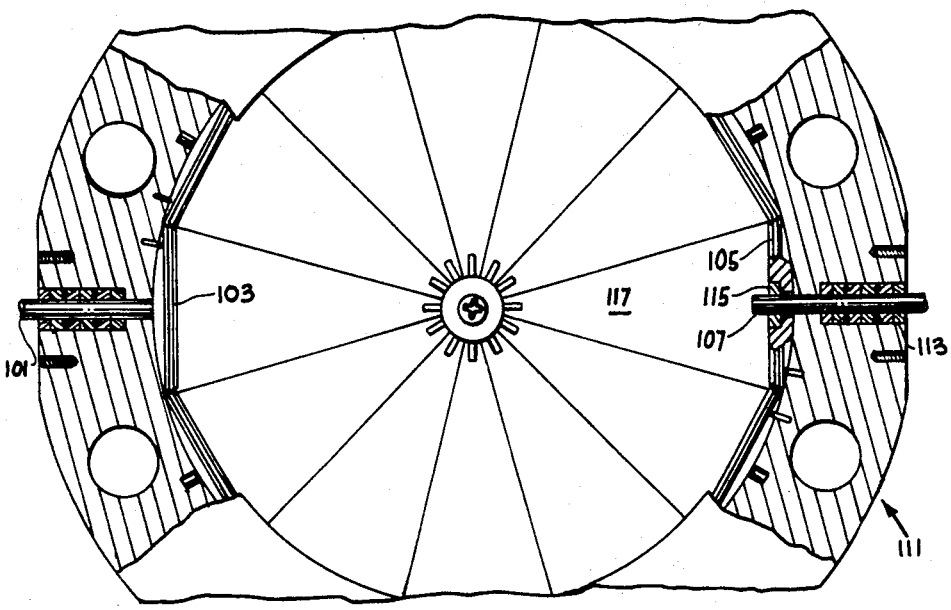
FIG. 9 is a top partially cutaway view of an alternate embodiment of the invention.

With reference to FIG. 9, an alternate embodiment of the invention is illustrated. In this embodiment, all of the vanes except one are controlled by rotational energy transmitted to the shims by shaft 101 to the driver shim 103. All of the shims operate in the usual way except that shim 105 has a shaft 107 extending through the shim. The shaft is rotationally independent of the shim. Shaft 107 extends through flange 111 in a sealed relationship by means of the shaft seal 113. Vane 105 has another shaft seal 115 in the shim supporting the shaft in a manner so that it can rotate independently of the shim. Shaft 107 is directly connected to vane 117 by direct attachment, such as a slit in the end of the shaft, with the side of the vane opposite the tip fitting into the shaft slit. In FIG. 9 it will be seen that there are a total of 12 vanes. If all of the vanes were driven by the driver shim, any vane motion would be multipled 12 times since the driver shim controls 11 other shims. However, in the configuration illustrated in FIG. 9, the driver shim controls only 11 vanes, with vane 117 being independently controlled by shaft 107. Shaft 101, which controls the driver shim 103, can provide coarse control of a valve, for initial pumping or when fine control is not necessary. Once the desired pressure is achieved, fine control of the valve may be maintained by maintaining all of the vanes, except vane 117, in a fixed position and independently operating vane 117 to provide desired fine correction. A servo controller can provide signals to actuators or motors which are controlling shafts 101 and 107. Such servo controllers are known. A servo controller having independent coarse and fine corrections may be used, or alternatively, two controllers may be used including one which is operative only during coarse corrections and the other which is operative once coarse corrections are completed and only fine corrections are needed. A closed loop servo system can identify when coarse corrections have achieved a desired pressure threshold. Below the desired pressure threshold, only fine corrections are used.

Figure 10:
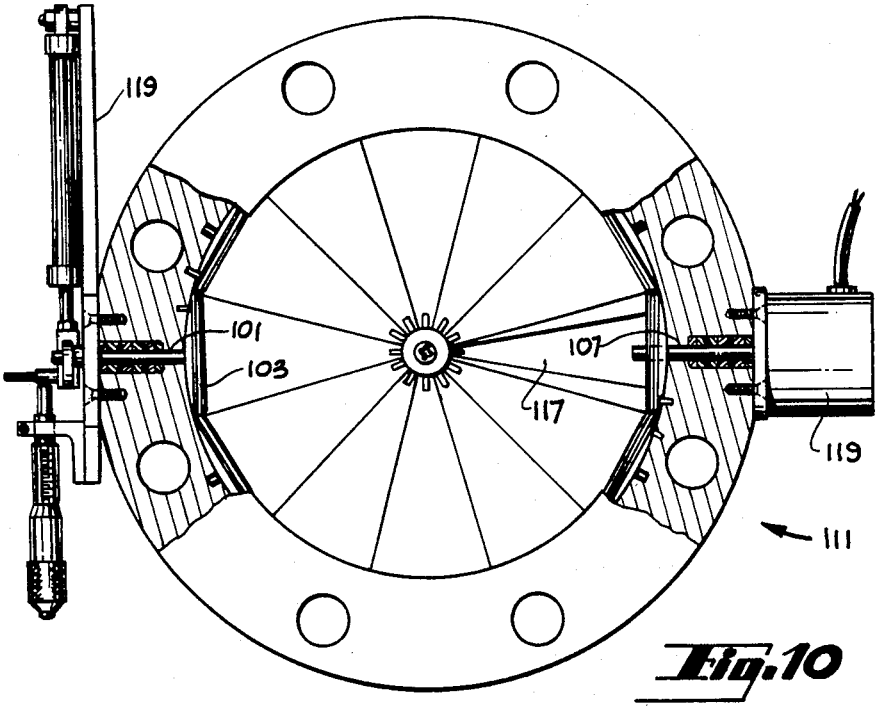
FIG. 10 is a view similar to FIG. 9 illustrating operation of the apparatus.

Corrections may be applied by a pair of stepper motors or by an actuator of the type illustrated in FIG. 1 for coarse corrections and a stepper motor for fine corrections. FIG. 10 is an operational view of the valve of FIG. 9 wherein an actuator 119 is used to control shaft 101, shim 103 and all of the other shims. The actuator is keeping the vanes of such shims in a position which would seal the orifice through flange 111.

One of the vanes, namely vane 117 is being independently controlled by shaft 107 which is being driven by motor 119. The vane 117 is shown in an inclined position which is different from the other vanes. In this position, gas can pass through the vanes from one side of the flange to the other. The view of FIG. 10 illustrates fine control used in the situation where coarse control is no longer in effect. During fine control, motor 119, by itself, operates vane 117, the only vane which moves during fine correction.

The concept of coarse and fine control need not be restricted to radial vane throttling valves, but may also be used in other kinds of vacuum throttling valves employing vanes. The control mechanism of the present invention may be thought of as a group of N vanes adapted to open and close an orifice defined within a flange with independent controls of two sets of vanes. A first set consists of (N−1) vanes which are mechanically linked for joint motion, such as by the rotatable shims described above. The first group of vanes is then mechanically linked through a shaft or other coupling means supported in the flange which opens and closes the vanes. A second group of vanes, namely the Nth vane, is independently linked to a second coupling means supported in the flange which communicates opening and closing motion from outside the flange to the vane, bypassing the first coupling means. In FIG. 10, this is done by means of a shaft which penetrates one of the shims and rotates independently of it. In this manner, (N−1) vanes provide coarse control, while the Nth vane provides fine control. Both coarse and fine control modes are in response to electrical signals from a controller in a closed loop servo loop.

b. Low Temperature Pump Structure

Figure 11:
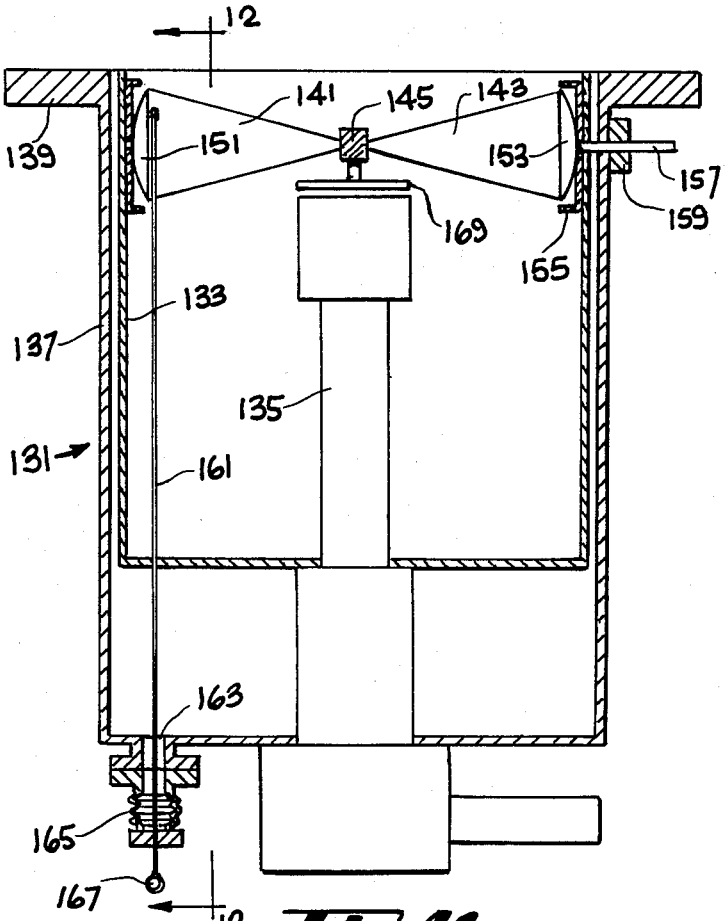
FIG. 11 is a side view of a low temperature pumping apparatus having a throttling valve mounted therein.

With reference to FIG. 11, a cryogenic pump 131 is shown of the type having two stages. The first stage has an outer surface wall 133 which is chilled to a medium temperature, approximately 77° K. The term "outer surface wall" means that the wall is radially outward from an inner surface wall 135 associated with a second pumping stage maintained at a low temperature, such as 14° K. Both the first and second pumping stages are coaxially disposed within a housing 137, exposed to ambient temperatures. Thermal isolation between outer wall 133 and housing 137 is provided by adequate spacing in a vacuum.

Housing 137 has an upper annular rim 139 for connection to vacuum components, valves or conduits connecting the pump to a process chamber through intermediate fixtures. Very low pressure operations occur at the process chamber. Some of the intermediate fixtures may include a roughing pump for achieving intermediate low pressures prior to the time that the process chamber is exposed to the low temperature pumping apparatus of the present invention. The throttling valve disclosed herein limits the amount of pumping done by a cryogenic pump. Using a throttling valve, a cryogenic pump may be brought on line gradually, or may be used to maintain a desired pressure, with even lower pressures available by opening of the vanes. When the vanes are fully opened, the full capacity of the pump is available to the process chamber through a port at the upper portion of the pump.

In FIG. 11, the vanes 141 and 143 are seen to be in the open position. The vanes are supported by a central hub 145, as previously described, and by shims 151 and 153 respectively. The shims may be mounted directly into the outer wall surface 133 or may be mounted in an annular flange 155 which is compressively fit within the outer wall surface. A shaft 157 projects through the outer wall surface and is made of an insulating material such as ceramic. The shaft further projects through housing 137 by means of a sealed bearing 159. Shaft 157 drives all of the vanes except one, vane 151 for coarse mode operation, as previously described. Vane 151 is independently controlled by means of a rod 161 which projects through housing 137 by means of an opening 163 and a bellows closure 165 which allows up-and-down movement of rod 161 when the free end 167 is moved vertically. This provides fine mode operation.

Hub 145 may be seen to support a downwardly extending shield 169 which blocks radiation entering from the top of the pump from striking the second stage, namely the inner wall surface 135.

One of the reasons for mounting the shims in a flange to be inserted within the outer wall surface is that there are many cryogenic pumps in use today. Many of these pumps do not have an adequate throttling system. Typically, cryogenic pumps have a baffle system near the top for preventing radiation from striking an inner wall surface. This baffling may be totally or partially removed in order to accommodate the vanes of the present invention. The prior art baffles are stationary and do not provide any throttling action. For these existing cryogenic pumps, an insertable throttling valve will provide increased pumping efficiency when the valve is wide open, even though the port, i.e., the region at the top of the outer wall surface, is slightly constricted by a flange 155 in which the vanes are seated. Alternatively, but at greater cost, the port region may be machined to accommodate the shims which are connected to the vanes, such that the port itself seats the vanes by means of the outer wall surface. Two-stage cryogenic pumps of the type described herein are manufactured by Varian Associates, Palo Alto, Calif., under the trademark "Cryostack."

Figure 12:
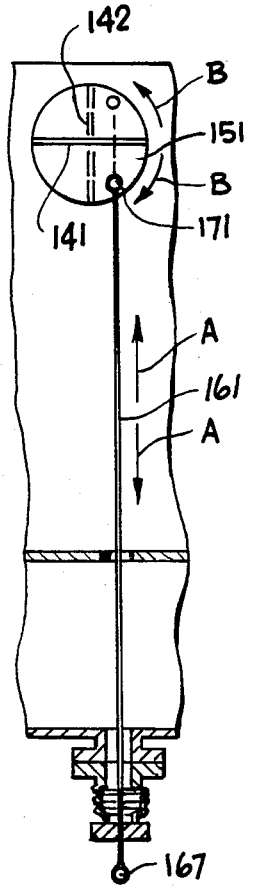
FIG. 12 is a side view taken along lines 12—13 in FIG. 11.

With reference to FIG. 12, the shim 151, supporting vane 141, may be seen to have a pin 171 to which the upper end of rod 161 is connected. When the rod is moved by means of motion at free end 167, motion indicated by arrows A is converted to rotary motion indicated by arrows B such that vane 141 turns from a first position to a second position indicated by the dashed lines 142.

Figure 13:
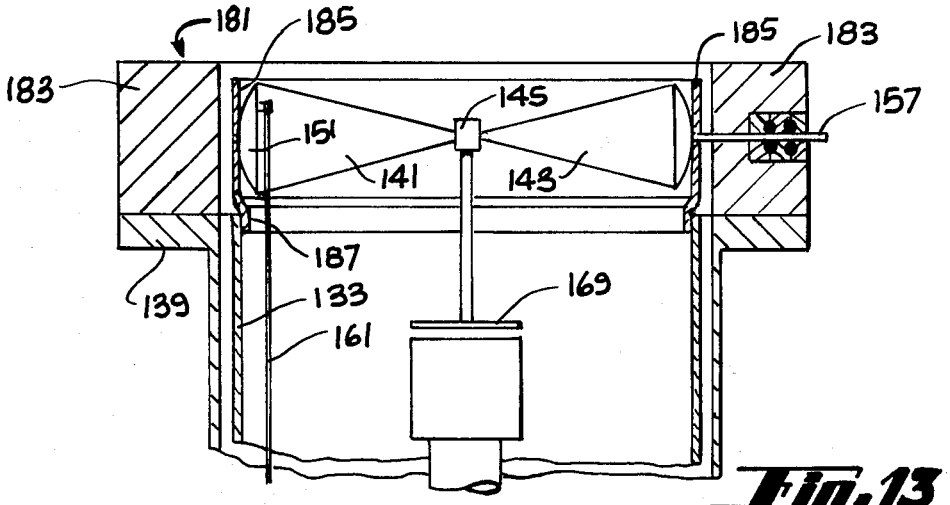
FIG. 13 is a side cutaway view of a low temperature pumping apparatus having a throttling valve mounted atop a port of a cryogenic pump.

FIG. 13 shows an alternative means of mounting a throttling valve relative to the port of a cryogenic pump. The port or upper region of the cryogenic pump has a rim 139 to which a flange 181 is connected. Flange 181 is split into an outer annular member 183 and an inner annular member 185. The inner and outer annular members are spaced in a thermal insulation relationship with respect to each other. However, the inner annular member 185 is in thermal contact with the chilled outer wall surface 133. Both in FIGS. 11 and 13, the vanes, such as vanes 141 and 143 are at approximately the same temperature as the outer wall surface 133. Thus the vanes form a portion of the first pumping stage. The inner annular member 185 sits atop outer wall surface 133 by means of a lip 187 extending slightly over the edge of the outer wall surface 133. The inner annular member 185 supports all of the vanes, as well as the central hub 145 and shield 169.

The vanes are controlled by means of a shaft 157 extending through both inner and outer annular members 183 and 185. Shaft 157 is a good insulator, as previously described. The valve of the present invention may be opened either by turning of shaft 157 or vertical motion of rod 161 for single mode operation, or may be opened separately by both shaft 157 and rod 161 for coarse and fine mode operation, as previously described.

The preferable shape for shield 169 is a disk, but other shapes, such as cones or umbrella structures may be used. Comparing FIG. 13 with FIG. 11 it will be seen that in FIG. 13 the throttling valve is added as an external unit to a cryogenic pump, while in FIG. 11, the valve is within the pump as an intergral member.

I claim:

1. Low-temperature pumping apparatus comprising, a cryogenic pump of the type having a chilled outer wall surface for first stage pumping of gases condensable at medium temperatures and a chilled inner wall surface for second stage pumping of gases condensable at low temperatures, said pump having a port facing a process chamber being pumped, a throttling valve disposed between the port and said process chamber, said throttling valve having a plurality of openable radial vanes disposed in side-by-side relation in a common plane and a means for mechanically linking said vanes to each other for communication of motion, said means located at vane edge opposite a radial center and within a structure into which said vane edge is mounted, said vanes mounted at said radial center for tilting out of the common plane and maintained in thermal contact with said outer pump surface wall, and means for imparting rotational motion to one of the said vanes from the exterior of said valve.

2. The apparatus of claim 1 wherein said vanes are mounted in a flange, the flange mounted atop the rim of the port.

3. The apparatus of claim 2 wherein said flange is split into inner and outer annular members, the inner annular member in thermal contact with the outer wall of the pump, the outer annular member in thermal insulation relation to the inner annular member.

4. The apparatus of claim 1 wherein said vanes are mounted in said outer wall surface within the port.

5. The apparatus of claim 1 wherein said vanes are mounted in an annular flange, the flange mounted coaxially within the port proximate to said outer wall.

6. The apparatus of claim 1 wherein said means for imparting rotational motion to one of said vanes comprises a rod extending in an axial direction through the pump and through an outer wall surface of said pump, the rod connected at one end to one of said vanes and having a free end outside of said pump.

7. The apparatus of claim 1 wherein said means for imparting rotational motion to one of said vanes comprises a shaft extending in a radial direction through an outer wall surface of the pump, the shaft connected at one end to a vane support and having a free end outside of the pump.

8. The apparatus of claim 1 wherein said vanes meet at a central hub, said hub having a central stationary shield disposed in the center of the port over said chilled inner surface in a spaced relation.

9. The apparatus of claim 1 wherein said means for mechanically linking said vanes comprises a plurality of rotatable shims having an outer toric surface, matching the curvature of the inner peripheral surface of a structure into which the vanes are mounted and having rotational support means for connection to the inner peripheral surface of said structure, each shim having a support side connected to a vane for transmitting shim rotation to a connected vane and further having rim means for transmitting rotational motion to rim means of adjacent shims, and the shims arranged in an endless rim-to-rim motive communication relation.

10. Low temperature pumping apparatus comprising, a cryogenic pump of the type having a chilled outer surface wall for first stage pumping of gases condensable at medium temperatures and a chilled inner surface wall for second stage pumping of gases condensable at low temperatures, said pump having a port facing a process chamber being pumped, and a radial vane throttling valve disposed across said port in a manner such that the valve throttles said port, said valve comprising, a group of N radially disposed vanes adapted to open and close said port with (N−1) vanes being mechanically linked for joint motion to a first coupling means supported near the port for communicating opening and closing motion from outside the pump to the (N−1) vanes and an Nth vane being independently linked to a second coupling means associated with the Nth vane for communicating opening and closing motion from outside the pump to the Nth vane, and control means operating the (N−1) vanes and the Nth vane independently of each other for providing coarse valve control by the (N−1) vanes and fine control by the Nth vane.

11. The apparatus of claim 10 wherein said vanes are mounted in a flange, the flange mounted atop the rim of the port.

12. The apparatus of claim 11 wherein said flange is split into inner and outer annular members, the inner annular member in thermal contact with the outer wall of the pump, the outer annular member in thermal insulation relation to the inner annular member.

13. The apparatus of claim 10 wherein said vanes are mounted in said outer wall surface within the port.

14. The apparatus of claim 10 wherein said vanes are mounted in an annular flange, the flange mounted coaxially within the port proximate to said outer wall.

15. The apparatus of claim 10 wherein said second coupling means comprises a rod extending through the outer wall surface of said pump, the rod connected at one end to the Nth vane and having a free end outside of said pump.

16. The apparatus of claim 10 wherein said vanes meet at a central hub, said hub having a central stationary shield disposed in the center of the port over said chilled inner surface in a spaced relation.

17. The apparatus of claim 16 wherein said shield is a disk.

18. Low temperature pumping apparatus comprising, a cyrogenic pump of the type having a chilled outer surface for first stage pumping of gases condensable at medium temperatures and a chilled inner wall surface for second stage pumping of gases condensable at low temperatures, said pump having a port facing a process chamber being pumped, and a radial vane throttling valve disposed across said port in a manner such that the valve throttles said port, said valve comprising, an annular flange having a continuous inner peripheral surface and a spaced apart, outer peripheral surface connected to the inner peripheral surface in a gas barrier relation between opposed side walls, a plurality of movable vanes disposable in a common plane closing the inside of the annular flange, said common plane parallel to the flange side walls, said vanes radially mounted for rotational shutter-like movement out of said common plane by inclining on an axis out of said common plane, a plurality of rotatable shims having an outer toric surface, matching the curvature of the inner peripheral surface of the flange and having a rotational support means for connection to the inner peripheral surface of the flange, each shim having a support side connected to a vane for transmitting shim rotation to a connected vane and further having rim means for transmitting rotational motion to rim means of adjacent shims, and the shims arranged in an endless rim-to-rim motive communication relation, coupling means supported in the flange from the outside peripheral region to the inside peripheral region for communicating rotary motion from outside the flange to one of the shims.

19. The apparatus of claim 18 wherein said vanes are in thermal contact with said outer wall surface.

20. The apparatus of claim 18 wherein said flange is mounted atop the rim of the port.

* * * * *

UNITED STATES PATENT AND TRADEMARK OFFICE

CERTIFICATE OF CORRECTION

PATENT NO. : 4,531,372

DATED : July 30, 1985

INVENTOR(S) : Edward J. Slabaugh

It is certified that error appears in the above—identified patent and that said Letters Patent is hereby corrected as shown below:

In the title: --Cyrogenic Pump Having Maximum Aperture Throttled Part-- should read "Cyrogenic Pump Having Maximum Aperture Throttled Port."

Col. 2, line 49: --taken along lines 12-13 in Fig. 11-- should read "taken along lines 12-12 in Fig. 11."

Col. 4, line 46: --shape of ease-- should read "shape because of ease."

Signed and Sealed this

First Day of April 1986

[SEAL]

*Attest:*

DONALD J. QUIGG

*Attesting Officer*

*Commissioner of Patents and Trademarks*